United States Patent [19]

Schöffmann et al.

[11] 4,368,102

[45] Jan. 11, 1983

[54] APPARATUS FOR REGULATING PULP DENSITY

[75] Inventors: Ernst Schöffmann; Alexander Czernuch, both of Reutlingen, Fed. Rep. of Germany

[73] Assignee: Bruderhaus Maschinen GmbH, Reutlingen, Fed. Rep. of Germany

[21] Appl. No.: 208,405

[22] Filed: Nov. 19, 1980

[30] Foreign Application Priority Data

Nov. 20, 1979 [DE] Fed. Rep. of Germany ..... 2946778

[51] Int. Cl.[3] ..... D21F 1/08; D21F 1/48

[52] U.S. Cl. ..... 162/258; 162/259; 162/310; 162/311

[58] Field of Search ..... 162/363, 364, 370, 371, 162/259, 309, 310, 311, 208, 211, 60, 183, 272, 297, 274, 275, 279, 308, 258

[56] References Cited

U.S. PATENT DOCUMENTS

| | | | |
|---|---|---|---|
| 1,623,278 | 4/1927 | Sears et al. | 162/310 |
| 1,746,434 | 2/1930 | Lowe | 162/310 |
| 2,028,952 | 11/1935 | Reiner | 162/208 |
| 2,683,415 | 11/1954 | Schur | 162/183 |
| 3,052,295 | 9/1962 | Magill, Jr. | 162/311 |
| 3,564,631 | 2/1971 | Burling | 162/60 |
| 3,981,768 | 9/1976 | Lentinen | 162/310 |
| 3,989,085 | 11/1976 | Crosby | 162/258 |
| 4,011,311 | 3/1977 | Nicholson . | |

FOREIGN PATENT DOCUMENTS

| | | | |
|---|---|---|---|
| 500956 | 6/1930 | Fed. Rep. of Germany | 162/310 |
| 1461152 | 4/1969 | Fed. Rep. of Germany . | |
| 1511233 | 7/1969 | Fed. Rep. of Germany . | |
| 1561663 | 4/1970 | Fed. Rep. of Germany . | |
| 2343538 | 4/1974 | Fed. Rep. of Germany . | |

*Primary Examiner*—Steve Alvo

*Attorney, Agent, or Firm*—Wigman & Cohen

[57] ABSTRACT

A method of and apparatus for regulating the pulp density above the moving screen of a machine which forms a continuous web from a fibrous suspension is disclosed. In its method aspects, the present invention discloses introducing water into the suspension located above the moving screen while also controlling the rate of flow and quantity of the water passing through the screen. In its apparatus aspects, the present invention discloses at least one plate arranged between the screen and a suspension containing chamber located beneath said screen, which plate includes water discharge openings on the side facing the chamber, at least one water support line communicating with the opposite side of the chamber and means for regulating the water discharge of the water supply into the chamber.

4 Claims, 5 Drawing Figures

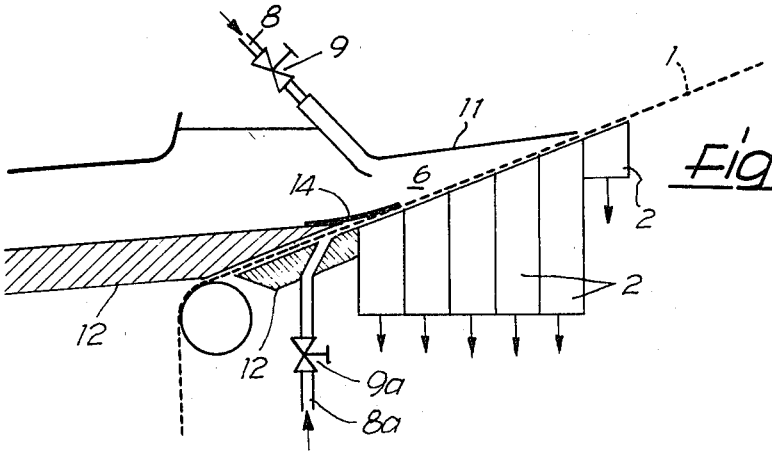
Fig.3.
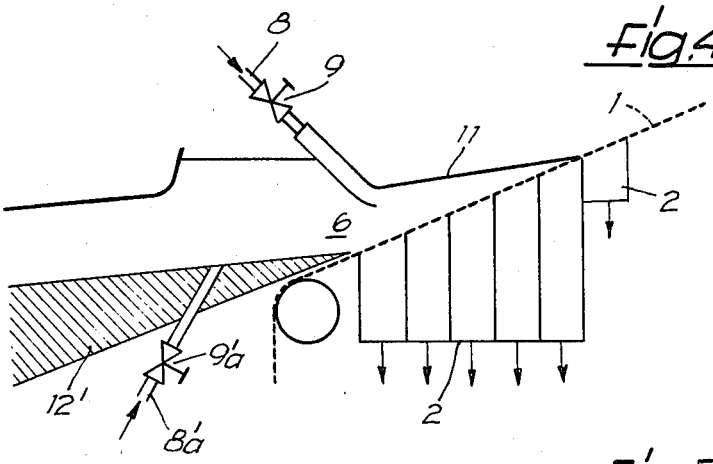
Fig.4.
Fig.5.
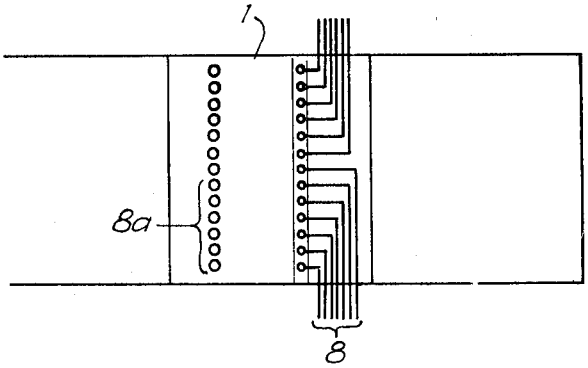

APPARATUS FOR REGULATING PULP DENSITY

BACKGROUND OF THE INVENTION

The present invention relates to a method for regulating the density of pulp on the screen of a machine which forms a continuous web from a fibrous suspension, and apparatus for performing the method.

When forming a continuous web from a fibrous suspension on a screen, the pulp density influences the quantity of fibers deposited on the screen, both over the web width and also over the length thereof. It is known in the prior art to adapt the fiber deposition to various requirements by controlling the water drainage from the underside of the screen. However, this method becomes less and less effective as the apparatus speed increases and also as the surface weight decreases. Furthermore, another problem which occurs in forming the continuous web cannot be solved by this means; namely, the significant fiber deposits at the edges of the web and the prevention of fiber deposits beneath the edge of the screen. Other measures must be taken to combat these problems. The same is also true, for example, in avoiding the formation of knots and mats on the screen leather.

SUMMARY AND OBJECTS OF THE INVENTION

One object of the present invention is to create a simple and yet widely usable method for regulating the pulp density above the screen of a machine which forms a continuous web from a fibrous suspension.

By controlling the introduction of water, which may be return or recycled water, into the suspension from the side of the screen or from above, the suspension can be brought to the desired fiber concentration and can even vary from one area to another. Thus, the fiber concentration may also reach a zero value. With the method according to the present invention, it is therefore quite simple to change the shape of the continuous web and the water distribution at the edge of the web and thus the deposit of fibers on the underside of the screen can also be prevented. Furthermore, according to the present invention, the fiber concentration in the area where a screen leather contacts the screen can be reduced to such an extent that no suspension is washed under the screen leather and therefore no knots or the like are formed at this location.

The present invention has the further object of creating a simple apparatus which requires the smallest possible amount of space to perform the method according to the invention.

It is a further object of the present invention to provide apparatus for regulating pulp density with a plurality of openings that can be connected to a common water feed line.

As a rule, very good results may be achieved with a perforated plate, a sheet metal sieve or a slotted sheet of metal, all of which are very simple embodiments of the plate. The plate, however, may also be formed as a nozzle support. In order that the water emitted from the discharge openings may act directly on the suspension, in a preferred embodiment, the plate forms a portion of the support surface for the screen in the screen region of a fleece deposit machine or paper machine. However, care must be taken that the upper side of the plate is smooth.

If the object of the apparatus is to prevent fibers from being deposited at the sides adjacent or beneath the screen, then the plate is disposed beneath the edge area of the screen. The width and arrangements of the plates are effectively selected so that they overlap the regulated area of the screen laterally to its direction of movement. The plate can also be arranged between the water removal area and a side wall which defines the lateral bounds of the sheet forming zone.

If water removal boxes are arranged beneath the screen in the sheet forming zone, then the plate can be associated with one or more of these boxes. However, two or more plates may be provided adjacent each other in the direction of movement of the screen in the section bordered by a box, in order to be able to effect great differences in different areas of the suspension.

If it is intended for the apparatus according to the present invention to correct the formation of knots and the like in the area of contact between a screen leather and the screen, then, preferably at least one plate is disposed in front of the contact surface of the screen leather and the water discharge is selected so that in the area of this surface the fiber concentration is very low or almost equal to zero.

To affect the shape of the continuous web, it is effective to distribute the arrangement of the water discharge openings over the entire width of the continuous web in the rigid portion of the pulp feed lying in front of the sheet forming zone. It is also desirable to separately control the water discharged from each discharge opening, formed, for example, by a nozzle.

With these and other objects, advantages and features of the invention that may become hereinafter apparent, the nature of the invention may be more clearly understood by reference to the following detailed description of the invention, the appended claims and to the several drawings attached herein.

BRIEF DESCRIPTION OF THE DRAWINGS

FIG. 3 is a partial schematic side view of an exemplary embodiment of the present invention;

FIG. 4 is a partial schematic side view of an alternative exemplary embodiment of the present invention; and FIG. 5 is a partial schematic top view of the screen used in an exemplary embodiment of the present invention showing the location of the supply lines across the screen.

DETAILED DESCRIPTION OF THE PREFERRED EMBODIMENT

Figure 1:
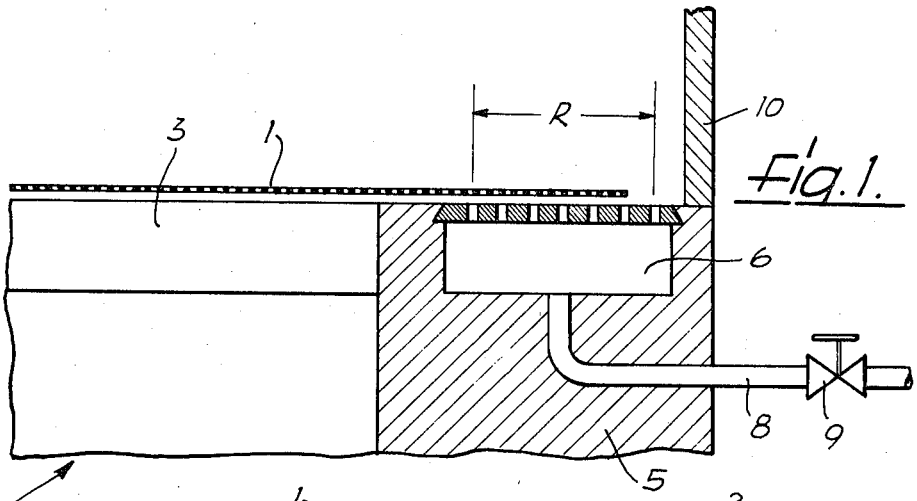
FIG. 1 is a schematic, partial vertical section of an exemplary embodiment of the present invention.

Referring now in detail to the drawings wherein like parts are designated by like numerals throughout, there is shown a machine for forming a continuous web from a fibrous suspension with the aid of a screen 1 which includes in its sheet forming zone a plurality of suction or dewatering boxes 2 arranged ajacent to each other in the direction of movement of the screen, the covers 3 of which form a smooth support surface for the screen 1. In the exemplary embodiment, this support surface forms an inclined plane which rises in the direction of movement of the screen. This is because the suction boxes 2 are elements of a fleece deposit machine in which the screen is in motion in a highly thinned fibrous suspension. The covers 3 of the suction boxes 2, however, could also form a horizontal or nearly horizontal screen support surface over which the upper lip of a pulp feed mechanism could extend. Each cover 3 has at least one opening formed as a slit 4 running lateral to the direction of movement of the screen, through which the water is aspirated from the underside of the screen.

Figure 2:
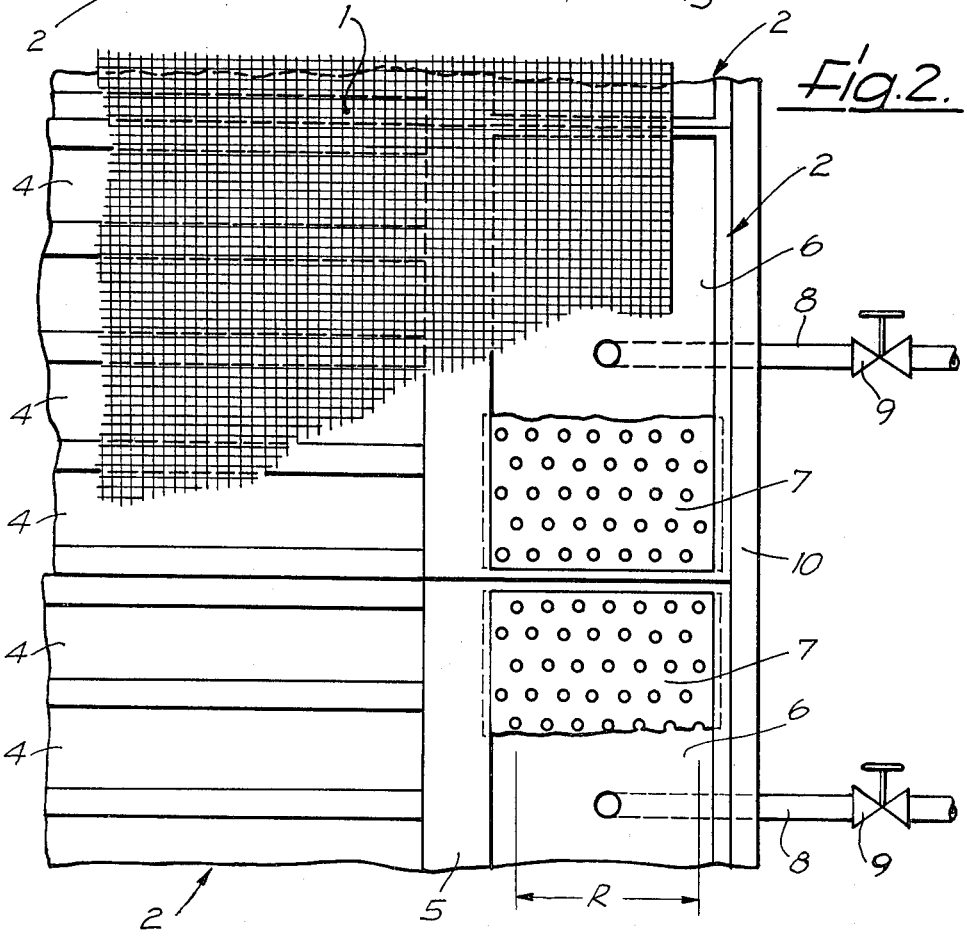
FIG. 2 is a schematic, incomplete top view of an exemplary embodiment of the present invention.

In both side walls 5 of each suction or dewatering box 2, of which only one is shown in FIGS. 1 and 2, there is provided or otherwise contained a chamber 6 which is arranged below but opens towards the moving screen 1 and has the shape of a groove as shown in FIG. 1, but could also be formed in another manner. On the side adjacent the screen 1, the chamber 6 is covered with a perforated plate 7, the upper side of which lies flush with the cover 3 of the suction box 2 and, like said cover, is smooth. The widths of the chamber 6 and the perforated plate 7, measured laterally to the direction of movement of the screen and the arrangement thereof, are selected such that they are covered by the overall screen regulating area R, i.e., the zone in which at least one of the two lateral side edges of the screen 1 may lie. In the direction of movement of the screen 1, the chamber 6 and the perforated plate 7 extend over almost the entire length of the associated suction box 2. It is also possible to select the length of the chamber 6 and the perforated plate 7 to be even larger, for example, to extend over two adjacent suction boxes. On the other hand, it is also possible to make the length of chamber 6, measured in the direction of movement of the screen, smaller than the corresponding length of the suction box. In this case, two or more separate chambers 6 would be provided adjacent to each other within the region of the single suction box. This type of narrow division of the chambers is advantageous, for example, in the last suction box before the fleece is removed from the suspension, in order to be able to individually regulate the water feed. Even with extremely wide suction boxes and rapidly elevated screens, an arrangement of two or more chambers adjacent to each other in the vicinity of a single suction box can be advantageous.

Each chamber 6 is connected to a water supply line 8. In the exemplary embodiment the water pressure and the quantity of water introduced into the chamber can be separately controlled for each water supply line 8, as is symbolically illustrated by respective control valves 9.

The water feed to the chambers 6 is adjusted in such a manner that the chambers are always filled with water and water is continuously discharged through the perforated plates 7. The quantity of water discharged and the resistance of the openings in the perforated plates 7 are selected such that the water passes through both the portion of the perforated plate covered by the screen as well as the screen 1 itself. In this manner, the edges of the screen 1 remain clean, i.e., free of fiber deposits, while simultaneously regulating the water distribution at the edge of the continuous web. Furthermore, the discharged water prevents the suspension from penetrating beneath the screen and thereby prevents the deposit of fibers therebeneath. Also, the water discharged through the perforated plates 7 assures that the suspension located above the edge vicinity of the screen is sufficiently thinned or displaced so that a uniform sheet is formed over the entire width of the continuous web.

As shown in FIGS. 1 and 2, the chambers 6 with their perforated covering plates 7 also permit a closed embodiment of the sheet forming chamber. The lateral bounds of the sheet forming chamber are defined by side shields 10 which are placed on the upper side of the suction boxes 2 in such a way that the perforated plates 7 still lie within the sheet forming area.

FIG. 3 shows a chamber 7, having an upper lip 11 and a lower lip 12. The chamber 6 has two water supply lines 8 and 8*a*, each with a respective control valve 9 and 9*a*. In FIG. 3, water is introduced from above and through the screen 1 in the flow direction of the suspension. A screen leather 14 lies on the lower lip 12 and on the screen 1 for bridging the gap between the lower lip 12 and the first of the plurality of suction boxes 2.

FIG. 4 shows another embodiment of the present invention in which water is also introduced from above in the suspension flow direction through water supply line 8 and its associated control valve 9. Additionally, water is also introduced in the suspension flow direction through the lower lip 12' by means of water supply line 8'*a* and its control valve 9'*a*.

FIG. 5 shows the location of the water supply lines 8 and 8*a* across the screen 1.

Should it be necessary to introduce water into the suspension from the chambers 6 over the entire width of the screen 1 or the entire contact surface for the screen, then all that would be necessary is an extension of the chambers and the perforated plates or the like covering them on the side adjacent the screen over the entire width. Two such chambers, for example, can be arranged on the screen ahead of and behind the support surface of the screen leather, in order to, as far as possible, avoid any concentration of fibers in the vicinity of this support surface, so that the fibers form no knots or the like in the vicinity of the screen leather.

It is also possible to extend the chamber over the entire width of the screen when it is desired to correct or adjust the shape of the continuous web with the aid of the water discharged from the chamber. In order to be able to achieve this type of local influence, it is effective to provide nozzles or the like in place of the perforated plates and to divide the chamber into separate compartments, each of which is associated with a nozzle. Each of these compartments may be connected to its own water supply line.

Although only a preferred embodiment is specifically illustrated and described herein, it will be appreciated that many modifications and variations of the present invention are possible in light of the above teachings and within the purview of the appended claims without departing from the spirit and intended scope of the invention.

What we claim is:

1. Apparatus for regulating pulp density in a machine which forms a continuous web from a fibrous suspension, comprising:

a moving screen having lateral edges and moving in a direction through the machine;

dewatering boxes over which the moving screen moves, said dewatering boxes having side walls which contain at least one chamber arranged below at least one lateral edge of the moving screen;

at least one perforated plate arranged between the moving screen and the chamber, said perforated plate forming an upper wall of the chamber and including water discharge openings therethrough, said perforated plate forming an element of a support surface for the moving screen and said perforated plate further being disposed beneath the at least one lateral edge of the moving screen;

at least one water supply line communicating through a bottom wall of said chamber; and means for regulating the water discharge of said water supply line into said chamber.

2. Apparatus according to claim 1, wherein said perforated plate is formed as a sheet metal sieve.

3. Apparatus according to claim 1, wherein said perforated plate is formed as a slotted metal sheet.

4. Apparatus according to claim 1, wherein the chamber has its own side walls between which said perforated plate is arranged thereover.

* * * * *